US011193215B2

(12) United States Patent
Sasayama

(10) Patent No.: US 11,193,215 B2
(45) Date of Patent: Dec. 7, 2021

(54) DEPOSITION METHOD OF NI—P—B SYSTEM ELECTROPLATING FILM, THE FILM, AND SLIDE MEMBER COMPRISING THE FILM

(71) Applicant: AISIN SEIKI KABUSHIKI KAISHA, Kariya (JP)

(72) Inventor: Hiroaki Sasayama, Nagoya (JP)

(73) Assignee: AISIN SEIKI KABUSHIKI KAISHA, Kariya (JP)

( * ) Notice: Subject to any disclaimer, the term of this patent is extended or adjusted under 35 U.S.C. 154(b) by 104 days.

(21) Appl. No.: 16/493,207

(22) PCT Filed: Mar. 14, 2018

(86) PCT No.: PCT/JP2018/009890

§ 371 (c)(1),
(2) Date: Sep. 11, 2019

(87) PCT Pub. No.: WO2018/193756

PCT Pub. Date: Oct. 25, 2018

(65) Prior Publication Data

US 2021/0054517 A1 Feb. 25, 2021

(30) Foreign Application Priority Data

Apr. 20, 2017 (JP) ..... JP2017-083975

(51) Int. Cl.
*C25D 3/12* (2006.01)

(52) U.S. Cl.
CPC ..... *C25D 3/12* (2013.01)

(58) Field of Classification Search
None
See application file for complete search history.

(56) References Cited

U.S. PATENT DOCUMENTS

| | | | | |
|---|---|---|---|---|
| 5,779,873 | A * | 7/1998 | Law | C25D 3/12 205/271 |
| 6,403,234 | B1 * | 6/2002 | Kodama | B32B 15/01 428/610 |
| 2013/0333436 | A1 * | 12/2013 | Nakajima | C25D 7/0614 72/342.1 |

FOREIGN PATENT DOCUMENTS

| | | | |
|---|---|---|---|
| CN | 1421607 | A | 6/2003 |
| CN | 1818141 | A | 8/2006 |
| JP | 63-79993 | A | 4/1988 |
| JP | 2000-274361 | A | 10/2000 |
| JP | 2002-31234 | A | 1/2002 |
| JP | 2006-169605 | A | 6/2006 |
| JP | 2007-16280 | A | 1/2007 |
| KR | 10-2005-0028449 | A | 3/2005 |

OTHER PUBLICATIONS

Nasser Kanani "Electroplating: Basic Principles, Processes and Practice", 2004, ISBN 978-1-85617-451-0, Chapter 3. (Year: 2004).*
International Search Report dated May 1, 2018 in PCT/JP2018/009890 (with English translation), 5 pages.
Written Opinion of the International Searching Authority dated May 1, 2018 in PCT/JP2018/009890, (with English translation), 10 pages.
S. Morisaki, et al., "Contents of Boron and Phosphorus in the Nickel Alloy Films Deposited by Electroplating and Electroless Plating" Japan Atomic Energy Research Institute, JAERI—Review 2004-016, Aug. 2004, pp. 519-521 and cover pages.
Keisuke Kishimoto, et al., "Effects of Various Additives on the Characteristics of Electroplated Nickel Thin Films" Journal of the Surface Finishing Society of Japan, vol. 54, No. 10, Oct. 2003, pp. 710-713 and cover pages.
Hirotaka Semba, "Ni—P—B-Electroless Plating" Journal of the Surface Finishing Society of Japan, vol. 53, No. 1, 2002, pp. 28-30.
Combined Chinese Office Action and Search Report dated Feb. 23, 2021 in Chinese Patent Application No. 201880025585.9 (with English translation), 14 pages.

* cited by examiner

*Primary Examiner* — Wojciech Haske
(74) *Attorney, Agent, or Firm* — Oblon, McClelland, Maier & Neustadt, L.L.P.

(57) ABSTRACT

In a deposition method of Ni—P—B system plating film, electroplating is performed in a plating bath containing Ni ions, phosphorous acid ions, alkylamine borane, acetic acid, at least one sort of a primary brightening agent, and a secondary brightening agent including at least one sort of a surface active agent. In the above-mentioned plating bath, concentration of alkylamine borane in said plating bath is 1.37 mmol/L or more, and concentration of acetic acid in said plating bath is 0.70 mol/L or more and less than 2.80 mol/L. Thereby, plating film having high hardness of Hv 700 or more can be deposited with high manufacturing efficiency without baking processing, while reducing occurrence of poor appearance, such as burning and abnormal precipitation, even when current density is increased to 80 A/dm$^2$ or more to raise deposition rate.

7 Claims, No Drawings

DEPOSITION METHOD OF NI—P—B SYSTEM ELECTROPLATING FILM, THE FILM, AND SLIDE MEMBER COMPRISING THE FILM

TECHNICAL FIELD

The present invention relates to a deposition method of Ni—P—B system electroplating film, the film, and a slide member comprising the film.

BACKGROUND ART

In the art, it has been known to deposit (form as film) plating film consisting of alloy which contains nickel (Ni), for example, on the surface of a slide member, such as a clutch hub, a hybrid damper, a piston and a gear, for example, for the purpose of improving corrosion resistance, abrasion resistance, fatigue strength and aestheticity, etc. for example. Deposition (film forming) methods of such plating film are classified roughly into a non-electrolytic plating (which may be referred to as a "chemical plating") and an electroplating (which may be referred to as an "electrolytic deposition").

For example, it has been proposed to improve an initial sliding characteristic, etc. by depositing plating film, such as Ni—P—B system plating film by non-electrolytic plating and thereafter making the plating film in contact with phosphate solution to form phosphate film on the plating film (refer to the Patent Document 1 (PTL1), for example). However, since non-electrolytic plating is a method to reduce a metal ion to be deposited as metal on raw material by a chemical reaction of the metal ion and a reducing agent, a film forming rate (deposition rate) is very slow, and its manufacturing efficiency is low. Moreover, it is necessary to exchange bath liquid frequently in order to maintain constant the compounding ratio of various components in a plating bath, and its production cost is high. Furthermore, since it is necessary to subject the plating film to baking processing when hardness and adhesion, etc. of the plating film need to be improved sufficiently, the manufacturing efficiency falls further. Since processing facilities, such as a heating device, and predetermined processing time according to its processing conditions, it may become a factor for increasing a production cost and decreasing manufacturing efficiency at thee baking processing.

On the other hand, in an electroplating, a film forming rate (rate of progress) is higher than that in the non-electrolytic plating, and the film forming rate can be raised by increasing a current density (refer to the Patent Document 2 (PTL2), for example). However, when the current density is increased excessively, there is a possibility that compactness of the formed film may fall and its hardness may fall and/or that poor appearance, such as what is called "burning" etc. may occur. Therefore, there is a limit in increasing the film forming rate by increasing the current density. Moreover, also in an electroplating, since it is necessary to subject the plating film to a baking processing when the hardness and adhesion, etc. of the plating film need to be improved sufficiently, there is a limit also in improving the manufacturing efficiency by an electroplating.

CITATION LIST

Patent Literature

[PTL1] Japanese Patent Application Laid-Open (kokai) No. 2006-169605

[PTL2] Japanese Patent Application Laid-Open (kokai) No. 2007-016280

SUMMARY OF INVENTION

Technical Problem

As mentioned above, in the art, although various attempts have been made to deposit plating film having high hardness with high manufacturing efficiency, a technology which can achieve both the hardness and manufacturing efficiency of plating film at a sufficiently high level has not yet been established. One of the objectives of the present invention is to provide a technology which can deposit plating film having high hardness with high manufacturing efficiency without baking processing.

Solution to Problem

As a result of wholeheartedly research, the present inventor has found out that current density can be increased to deposit (form as film) plating film having high hardness with high manufacturing efficiency without baking processing, while reducing occurrence of poor appearance, such as what is called "burning" and abnormal precipitation, for example, by keeping concentrations of alkylamine borane and acetic acid in a plating bath within a predetermined range in a method for depositing nickel (Ni)-phosphorus (P)-boron (B) system plating film by electroplating.

Specifically, a deposition method of Ni—P—B system plating film according to the present invention (which may be referred to as a "present invention method" hereafter) is a deposition method of Ni—P—B system plating film, in which electroplating is performed in a plating bath containing Ni ions, phosphorous acid ions, alkylamine borane, acetic acid, at least one sort of a primary brightening agent, and a secondary brightening agent including at least one sort of a surface active agent. In the above-mentioned plating bath, concentration of alkylamine borane in said plating bath is 1.37 mmol/L or more, and concentration of acetic acid in said plating bath is 0.70 mol/L or more and less than 2.80 mol/L.

Furthermore, in Ni—P—B system plating film according to the present invention (which may be referred to as a "present invention film" hereafter), a content rate of Ni is 90 at % or more and 98 at % or less, a content rate of P is 1 at % or more and 9 at % or less, and a content rate of B is 0.1 at % or more and less than 1 at %. Furthermore, hardness of the present invention film is Hv 700 or more, and size of a crystallite measured by X-ray diffraction (XRD) of the present invention film is 4 nm or more and 10 nm or less.

In addition, a slide member according to the present invention (which may be referred to as a "present invention member" hereafter) is a slide member which comprises the above-mentioned present invention film formed at least on a surface of a sliding part.

Advantageous Effects of Invention

In accordance with the present invention method, current density can be increased to deposit plating film having high hardness with high manufacturing efficiency, while reducing occurrence of poor appearance, such as burning and abnormal precipitation, for example. Moreover, as will be mentioned later in detail, in accordance with the present invention method, high hardness can be attained in the Ni—P—B system plating film just after electroplating. Namely, the above-mentioned baking processing is not an essential constituent element in the present invention method. Therefore, also from such a viewpoint, in accordance with the present invention method, a film forming rate of plating film can be, raised to improve manufacturing efficiency.

Furthermore, the present invention film has a high hardness without baking processing, and can attain high abrasion resistance, fatigue strength, etc. In addition, the present-invention member can demonstrate high sliding characteristic since the present invention film is formed at least on a surface of a sliding part thereof. As mentioned above, in accordance with the present-invention, both the hardness and manufacturing efficiency of plating film can be achieved at a sufficiently high level.

Other objectives, other features and accompanying advantages of the present invention will be easily understood from the explanation about respective embodiments of the present invention which will be described below referring to drawings.

DESCRIPTION OF EMBODIMENTS

First Embodiment

Hereafter, a deposition method of Ni—P—B system plating film according to a first embodiment of the present invention (which may be referred to as a "first method" hereafter) will be explained.

<Configuration>

The first method is a deposition method of nickel (Ni)-phosphorus (P)-boron (B) system plating film. In the first method, electroplating is performed in a plating bath containing Ni ions, phosphorous acid ions, alkylamine borane, acetic acid, at least one sort of a primary brightening agent, and a secondary brightening agent including at least one sort of a surface active agent.

As a supply source of Ni ions, substances well-known to a person skilled in the art, such as nickel sulfate ($NiSO_4$), nickel sulfamate ($Ni(NH_2SO_3)_2$) and nickel chloride ($NiCl_2$), etc., can be adopted, for example. As a supply source of phosphorous acid ions, for example, substances well-known to a person skilled in the art, such as sodium phosphite ($Na_2HPO_3$) and potassium phosphite ($K_2HPO_3$), etc., can be adopted, for example.

As specific examples of alkylamine borane, trialkyl amine borane and dialkyl amine borane, etc. can be mentioned, for example. As specific examples of trialkyl amine borane, trimethylamine borane and triethyl amine borane, etc, can be mentioned, for example. As specific examples of dialkyl amine borane, dimethylamine borane and diethyl amine borane, etc. can be mentioned, for example.

As the primary brightening agent, substances well-known to a person skilled in the art, such as aromatic sulphonic acids (such as benzenesulfonic acid), aromatic sulfonamides (such as p-toluene sulfonamide), and aromatic sulfonimides (such as saccharin and saccharin sodium), can be adopted, for example. As the secondary brightening agent, substances well-known to a person skilled in the art, such as aldehydes (such as formaldehyde), allyl compounds (vinyl compounds) (such as allyl sulfonic acids), acetylene compounds (such as 2-butyne-1,4-diol) and nitrils (such as ethyl cyan hydrin), can adopted, for example. However, the secondary brightening agent contained in the plating bath used in the first method contains a surface active agent as an essential constituent. In other words, the secondary brightening agent contains at least one sort of surface active agent.

As the above-mentioned surface active agent, surface active agents well-known to a person skilled in the art, such as nonionic surface active agents (such as polyoxyethylene alkyl ethers), cationic surface active agents (such as lauryl amine and dodecyl amine) and anionic surface active agents (such as sodium lauryl sulfate and sodium dodecyl sulfate) can be adopted, for example.

Furthermore, the concentration of alkylamine borane in the above-mentioned plating bath is 1.37 mmol/L or more. For example, when adopting trimethylamine borane as alkylamine borane, the concentration of trimethylamine borane in the above-mentioned plating bath is 0.1 g/L or more. Thereby, eutectoid of boron (B) into the plating film can be promoted, ternary alloy film of Ni—P—B system can be formed more certainly, and hardness of the Ni—P—B system plating film can be raised.

In addition, the concentration of acetic acid in the above-mentioned plating bath is 0.70 mol/L or more and less than 2.80 mol/L. In other words, the concentration of acetic acid in the above-mentioned plating bath will be 40 mL/L or more and less than 160 mL/L. By keeping the concentration of acetic acid at 0.70 mol/L or more, occurrence of poor appearance, such as burning and abnormal precipitation, can be reduced even when the current density during deposition of the plating film is raised. In other words, the current density during deposition of the plating film can be raised while reducing the occurrence of poor appearance, such as burning and abnormal precipitation. As a result, the film forming rate of the plating film can be raised and manufacturing efficiency can be raised. Moreover, it is not preferred that the concentration of acetic acid is 2.80 mol/L or more, since solubility of supply source of Ni ions (for example, nickel sulfate ($NiSO_4$), etc.) in the plating bath falls, a part of the supply source of Ni ions is not dissolved to remain as a solid body, and it becomes difficult to raise the concentration of Ni ions.

In addition, as mentioned above, in accordance with the deposition method of Ni—P—B system plating film according to various embodiments of the present invention (present invention method) including the first method, high hardness can be attained in the Ni—P—B system plating film just after electroplating. Namely, the above-mentioned baking processing is not an essential constituent element in the first method. Therefore, also from such a viewpoint, in accordance with the first method, a film forming rate of plating film can be raised to improve manufacturing efficiency.

<Effects>

As mentioned above, in accordance with the first method, current density can be raised to improve manufacturing efficiency while reducing occurrence of poor appearance, such as burning and abnormal precipitation, for example, and Ni—P—B system plating film having high hardness can be deposited. Namely, in accordance with the first method, both the hardness and manufacturing efficiency of plating film can be achieved at a sufficiently high level.

Second Embodiment

Hereafter, a deposition method of Ni—P—B system plating film according to a second embodiment of the present invention (which may be referred to as a "second method" hereafter) will be explained.

<Configuration>

The second method is one of more preferable embodiments of the above-mentioned first method, and a deposition method of Ni—P—B system plating film characterized in that trialkyl amine borane or dialkyl amine borane is adopted as the alkylamine borane and anionic surface active agent is adopted as the surface active agent.

<Effects>

In accordance with the second method, current density can be raised to improve manufacturing efficiency while reducing occurrence of poor appearance, such as burning and abnormal precipitation, for example, and Ni—P—B system plating film having high hardness can be deposited more certainly. Namely, in accordance with the second method, both the hardness and manufacturing efficiency of plating film can be achieved at a higher level.

Third Embodiment

Hereafter, a deposition method of Ni—P—B system plating film according to a third embodiment of the present invention (which may be referred to as a "third method" hereafter) will be explained.

<Configuration>

The third method is one of more preferable embodiments of the above-mentioned second method, and a deposition method of Ni—P—B system plating film characterized in that trimethylamine borane or dimethylamine borane is adopted as the alkylamine borane and sodium dodecyl sulfate is adopted as the surface active agent.

<Effects>

In accordance with the third method, current density can be raised to improve manufacturing efficiency while reducing occurrence of poor appearance, such as burning and abnormal precipitation, for example, and Ni—P—B system plating film having high hardness can be deposited further more certainly. Namely, in accordance with the third method, both the hardness and manufacturing efficiency of plating film can be achieved at a further higher level.

Fourth Embodiment

Hereafter, a deposition method of Ni—P—B system plating film according to a fourth embodiment of the present invention (which may be referred to as a "fourth method" hereafter) will be explained.

In the deposition method of Ni—P—B system plating film according to various embodiments of the present invention (present invention method) including the above-mentioned first to third methods, by keeping the concentration of acetic acid in the plating bath within a predetermined range (specifically, 0.70 mol/L or more and less than 2.80 mol/L), occurrence of poor appearance, such as burning and abnormal precipitation, can be reduced even when the current density during deposition of the plating film is raised.

As a result of wholeheartedly research, the present inventor has found out that, in accordance with the present-invention method, surprisingly, Ni—P—B system plating film having high hardness can be deposited (formed as a film) while reducing occurrence of poor appearance, such as burning and abnormal precipitation, for example, even when electroplating is performed at high current density of 80 A/dm or more.

<Configuration>

Then, the fourth method is one of more preferable embodiments of the above-mentioned first to third methods, and a deposition method of Ni—P—B system plating film characterized in that current density is 80 A/dm$^2$ or more when performing the electroplating.

<Effects>

In accordance with the fourth method, Ni—P—B system plating film having high hardness can be deposited with higher manufacturing efficiency while reducing occurrence of poor appearance, such as burning and abnormal precipitation, for example. Namely, in accordance with the fourth method, Ni—P—B system plating film having high hardness and quality can be deposited with higher manufacturing efficiency

Fifth Embodiment

As mentioned at the beginning of this specification, the present invention relates not only to the above-mentioned deposition methods of Ni—P—B system plating film, but also to Ni—P—B system electroplating film. Hereafter, Ni—P—B system plating film according to a fifth embodiment of the present invention (which may be referred to as a "fifth film" hereafter) will be explained.

<Configuration>

The fifth film is plating film which consists of ternary alloy of Ni—P—B system. In the fifth film, a content rate of nickel (Ni) is 90 at % or more and 98 at % or less, a content rate of phosphorus (P) is 1 at % or more and 9 at % or less, and a content rate of boron (B) is 0.1 at % or more and less than 1 at %. Content rates of respective components contained in such film can be measured by analysis methods well-known to a person skilled in the art, such as a secondary-ion-mass-spectrometry (SIMS), for example.

Furthermore, hardness of the fifth film is Hv 700 or more. Namely, the hardness of the fifth film measured by the Vickers hardness test (Japanese Industrial Standards Z 2244) using a Vickers hardness meter, for example, is Hv 700 or more. In addition, size of a crystallite measured by X-ray diffraction of the fifth film is 4 nm or more and 10 nm or less.

In addition, the fifth film having the configuration as mentioned above can be deposited (formed as a film) by the deposition method of Ni—P—B system plating film according to various embodiments of the present invention (present invention method) including the above-mentioned first to forth methods.

<Effects>

As mentioned above, the fifth film has a dense structure which consists of quite small crystallites. As a result, the fifth film has high hardness and can attain high abrasion resistance and fatigue strength, etc. Therefore, sliding characteristic of a slide member can be improved by depositing the fifth film on a surface of a sliding part of the slide member, for example.

Sixth Embodiment

Hereafter, Ni—P—B system plating film according to a sixth embodiment of the present invention (which may be referred to as a "sixth film" hereafter) will be explained.

<Configuration>

The sixth film is the above-mentioned fifth film, and a content rate of carbon (C) is 0.1 at % or more and a content rate of sulfur (S) is 0.1 at % or more. Content rates of carbon (C) and sulfur (S) contained in such film can be also measured by analysis methods well-known to a person skilled in the art, such as a secondary-ion-mass-spectrometry (SIMS), for example.

In the sixth film, by depositing the film such that the content rates of carbon (C) and sulfur (S) in the film are within the above-mentioned range, a crystal structure which constitutes the plating film can be micronized (made fine), and high hardness can be attained more certainly.

<Effects>

As mentioned above, in accordance with the sixth film, a dense structure which consists of quite small crystallites can be attained more certainly. As a result, the sixth film has high hardness and can attain high abrasion resistance and fatigue strength, etc. Therefore, sliding characteristic of a slide member can be improved by depositing the sixth film on a surface of a sliding part of the slide member, for example.

Seventh Embodiment

As mentioned at the beginning of this specification, the present invention relates not only to the above-mentioned deposition methods of Ni—P—B system electroplating film and the film, but also to a slide member which comprises Ni—P—B system electroplating film. Hereafter, a slide member according to a seventh embodiment of the present invention (which may be referred to as a "seventh member" hereafter) will be explained.

<Configuration>

The seventh member is a slide member which comprises plating film formed at least on a surface of a sliding part, the plating film is Ni—P—B system plating film according to various embodiments of the present invention (present invention film) including the above-mentioned fifth film and sixth film.

<Effects>

As mentioned above, the present invention film has high hardness, and can attain high abrasion resistance and fatigue strength, etc. Therefore, the seventh member which comprises the present invention film formed at least on the surface of the sliding part can demonstrate high sliding characteristic.

Working Example

Here, a deposition method of Ni—P—B system plating film according to a Working Example of the present invention and various properties of the film will be explained in detail, while contrasting with some Comparative Examples.

<<Preparation of Samples for Evaluation>>

<Plating Bath>

As plating baths for depositing plating film according to Comparative Example 1 to Comparative Example 6 as examples of a conventional technology and Working Example 1 to Working Example 9 as examples of the present invention, various plating baths (500 mL) listed in the following Table 1 and Table 2 were prepared. In Table 1 and Table 2, "CE" stands for Comparative Examples and "WE" stands for Working Examples.

In the examples shown in Table 1, nickel sulfate hexahydrate ($NiSO_4.6H_2O$) was adopted as a supply source of Ni ions, sodium phosphite ($Na_2HPO_3$) was adopted as a supply source of phosphorous acid ions, and trimethylamine borane (TMAB) was adopted as a supply source of boron (B), respectively. Moreover, saccharin sodium dihydrate ($C_7H_4NNaO_3S.2H_2O$) was adopted as a primary brightening agent, and the 2-butyne 1,4-diol ($C_4H_6O_2$) and sodium dodecyl sulfate ($NaC_{12}H_{25}SO_4$) were adopted as a secondary brightening agent, respectively. On the other hand, in the examples shown in Table 2, trimethylamine borane (TMAB), dimethylamine borane (DMAB) and dimethyl sulfide borane (DMSB) were properly used as supply sources of boron (B) as will be mentioned later in detail. Moreover, none of a primary brightening agent and a secondary brightening agent was blended in a part of the plating baths.

TABLE 1

| | | | CE1 | CE2 | CE3 | CE4 | WE1 | WE2 |
|---|---|---|---|---|---|---|---|---|
| Film | | | Ni—P | Ni—P | Ni—P | Ni—P | Ni—P—B | Ni—P—B |
| Plating Bath | $NiSO_4 \cdot 6H_2O$ | mol/L | 1.52 | ← | ← | ← | ← | ← |
| | $Na_2HPO_3$ | mmol/L | 41 | ← | ← | ← | ← | ← |
| | Acetic Acid ($CH_3COOH$) | mol/L | 0.52 | ← | 0.70 | 1.40 | ← | ← |
| | $C_7H_4NNaO_3S \cdot 2H_2O$ | mmol/L | 0 | 4.15 | ← | ← | ← | ← |
| | $C_4H_6O_2$ | mmol/L | 0 | 17.42 | ← | ← | ← | ← |
| | $NaC_{12}H_{25}SO_4$ | mmol/L | 0 | 5.20 | ← | ← | ← | ← |
| | TMAB | mmol/L | 0 | ← | ← | ← | 5.48 | 10.97 |
| Appearance | Abnormal Precipitation | — | Exists | Exists | None | None | None | None |
| Hardness | Vickers Hardness | Hv | 350 | 450 | 550 | 650 | 720 | 760 |
| Composition | Nickel (Ni) | at % | 98 | 98 | 98 | 98 | 98 | 98 |
| | Phosphorus | at % | 1.55 | 1.59 | 1.55 | 1.60 | 1.53 | 1.45 |
| | Boron (B) | at % | 0 | 0 | 0 | 0 | 0.12 | 0.15 |
| | Carbon (C) | at % | 0 | 0.02 | 0.04 | 0.07 | 0.18 | 0.21 |
| | Sulfur (S) | at % | 0 | 0.03 | 0.10 | 0.11 | 0.13 | 0.13 |
| | Crystallite Size (200) | nm | 22 | 20 | 6 | 6 | 4 | 4 |

TABLE 2

| | | | CE5 | WE3 | WE4 | WE5 | WE6 |
|---|---|---|---|---|---|---|---|
| Film | | | Ni—P—B | Ni—P—B | Ni—P—B | Ni—P—B | Ni—P—B |
| Plating Bath | $NiSO_4 \cdot 6H_2O$ | mol/L | 1.52 | ← | ← | ← | ← |
| | $Na_2HPO_3$ | mmol/L | 41 | ← | ← | ← | ← |
| | Acetic Acid ($CH_3COOH$) | mol/L | 1.40 | ← | ← | ← | ← |
| | $C_7H_4NNaO_3S \cdot 2H_2O$ | mmol/L | 0 | 4.15 | ← | ← | ← |
| | $C_4H_6O_2$ | mmol/L | 0 | 17.25 | ← | ← | ← |
| | $NaC_{12}H_{25}SO_4$ | mmol/L | 0 | 5.20 | ← | ← | ← |

TABLE 2-continued

| | | | | | | | |
|---|---|---|---|---|---|---|---|
| | TMAB | mmol/L | 10.97 | 16.44 | 21.92 | 2.74 | 1.37 |
| | DMAB | mmol/L | 0 | ← | ← | ← | ← |
| | DMSB | mmol/L | 0 | ← | ← | ← | ← |
| Appearance | Abnormal Precipitation | — | None | None | None | None | None |
| Hardness | Vickers Hardness | Hv | 670 | 720 | 730 | 710 | 700 |
| | Crystallite Size (200) | nm | 12 | 4 | 4 | 4 | 4 |

| | | | | WE7 | WE8 | WE9 | CE6 |
|---|---|---|---|---|---|---|---|
| | Film | | | Ni—P—B | Ni—P—B | Ni—P—B | Ni—P—B |
| | Plating | $NiSO_4 \cdot 6H_2O$ | mol/L | ← | ← | ← | ← |
| | Bath | $Na_2HPO_3$ | mmol/L | ← | ← | ← | ← |
| | | Acetic Acid ($CH_3COOH$) | mol/L | 2.10 | 1.40 | ← | ← |
| | | $C_7H_4NNaO_3S \cdot 2H_2O$ | mmol/L | ← | ← | ← | ← |
| | | $C_4H_6O_2$ | mmol/L | ← | ← | ← | ← |
| | | $NaC_{12}H_{25}SO_4$ | mmol/L | ← | ← | ← | ← |
| | | TMAB | mmol/L | 5.48 | 0 | ← | ← |
| | | DMAB | mmol/L | ← | 5.48 | 10.97 | 0 |
| | | DMSB | mmol/L | ← | ← | ← | 10.97 |
| | Appearance | Abnormal Precipitation | — | None | None | None | None |
| | Hardness | Vickers Hardness | Hv | 710 | 710 | 700 | 665 |
| | | Crystallite Size (200) | nm | 4 | 4 | 4 | — |

<Electroplating>

Various plating baths listed in Table 1 and Table 2 were heated at 65° C., electroplating is performed for 1 minute at a current density of 100 A/dm$^2$, using an insoluble Ti/Pt electrode as a counter electrode, while agitating at a rotational frequency of 1000 rpm using a magnetic stirrer, plating film having a thickness of 10 micrometers was deposited on a surface of each of test pieces made of iron (Fe) and having a 20 mm×20 mm square shape, and various samples for evaluation according to Comparative Example 1 to Comparative Example 6 and Working Example 1 to Working Example 9 were prepared. In addition, none of these samples for evaluation was subjected to baking processing after deposition.

<Evaluation Method>

(1) Hardness

Vickers hardness number was measured, using a Vickers hardness meter, by pressing the surface of each of the various test pieces with a load of 25 g for 10 seconds.

(2) Film Composition

Content rates of respective components in the film were measured by the secondary-ion-mass-spectrometry (SIMS). However, as for Comparative Examples 5 and 6 and Working Examples 3 to 9 shown in Table 2, analysis of film composition was omitted.

(3) Crystallite Size

Based on a diffraction chart (spectrum) measured by X-ray diffraction (XRD), crystallite size in a crystal orientation plane (200) was measured using Scherrer's formula.

<Evaluation Results>

As for Comparative Example 1, since none of the primary brightening agent and the secondary brightening agent was blended in the plating bath, abnormal precipitation occurred all over the test piece, and hardness of the film was Hv 350, which is insufficient. This is considered to be because, reflecting the composition of the plating bath, boron (B), carbon (C) and sulfur (S) could not be taken into the film, micronization of crystals could not progress (crystallite size=22 nm), and dense film structure could not be formed.

Comparative Example 2 is a sample for evaluation which has plating film similar to the plating film described in the Patent Document 2 (PTL2). As for Comparative Example 2, even though the primary brightening agent and the secondary brightening agent were blended in the plating bath, abnormal precipitation occurred all over the test piece, and hardness of the film was Hv 450, which is insufficient. This is considered to be because, reflecting the composition of the plating bath, boron (B) could not be taken into the film, only quite small amount of carbon (C) and sulfur (S) could be taken into the film, micronization of crystals could not progress (crystallite size=20 nm), and dense film structure could not be formed.

In Comparative Example 3, the same plating bath as Comparative Example 2 was used, except that the concentration of acetic acid in the plating bath is raised from 0.52 mmol/L (30 mL/L) to 0.70 mmol/L (40 mL/L). As for Comparative Example 3, abnormal precipitation could be suppressed as the result of the increased amount of acetic acid. However, although micronization of crystals was promoted to crystallite size of 6 nm, hardness of the film was Hv 550, which is still insufficient. Moreover, although carbon (C) and sulfur (S) in the film were increased slightly, existence of boron (B) was not recognized in the film reflecting the composition of the plating bath.

In Comparative Example 4, the same plating bath as Comparative Example 3 was used, except that the concentration of acetic acid in the plating bath is further raised to 1.40 mmol/L (80 mL/L). As for Comparative Example 4, abnormal precipitation could be suppressed as the result of the further increased amount of acetic acid, and good appearance could be attained. However, although micronization of crystals was promoted to crystallite size of 6 nm, hardness of the film was Hv 650, which is still insufficient. Moreover, although carbon (C) and sulfur (S) in the film were increased slightly, existence of boron (B) was not recognized in the film reflecting the composition of the plating bath.

On the other hand, in Working Example 1 according to the present invention, the same plating bath as Comparative Example 4 was used, except that 5.48 mmol/L (0.4 g/L) of trimethylamine borane (TMAB) was added to the plating bath. As for Working Example 1, abnormal precipitation could be suppressed as the result of addition of TMAB, and good appearance could be attained. Furthermore, crystallite size was 4 nm and micronization of crystals was promoted. As a result, sufficiently high film hardness of Hv 720 could be attained, even though baking processing after deposition was not performed. Moreover, boron (B), carbon (C) and sulfur (S) in the film were increased.

In Working Example 2, the same plating bath as Working Example 1 was used, except that the concentration of TMAB in the plating bath is further raised to 10.97 mmol/L (0.8 g/L). Also as for Working Example 2, abnormal precipitation could be suppressed and good appearance could be attained. Furthermore, crystallite size was 4 nm and micronization of crystals was promoted. Moreover, very high film hardness of Hv 760 could be attained with the increases amount of TMAB. The content rates of boron (B) and carbon (C) in the film were slightly increased as compared with Working Example 1.

In Comparative Example 5, the same plating bath as Working Example 2 was used, except that none of the primary brightening agent and the secondary brightening agent was blended in the plating bath. In this case, crystallite size became 12 nm. Namely, as compared with Working Example 2, micronization of crystals was suppressed. As a result, film hardness was Hv 670, which is still insufficient.

In Working Example 3, the same plating bath as Working Example 2 was used, except that the concentration of TMAB was raised to 16.44 mmol/L. In this case, crystallite size was 4 nm. As a result, very high film hardness of Hv720 could be attained.

In Working Example 4, the same plating bath as Working Example 2 was used, except that the concentration of TMAB is further raised to 21.92 mmol/L. In this case, crystallite size was 4 nm. As a result, very high film hardness of Hv 730 could be attained.

In Working Example 5, the same plating bath as Working Example 2 was used, except that the concentration of TMAB low was decreased to 2.74 mmol/L. In this case, crystallite size was 4 nm. As a result, very high film hardness of Hv 710 could be attained.

In Working Example 6, the same plating bath as Working Example 2 was used, except that the concentration of TMAB was further decreased to 1.37 mmol/L. In this case, crystallite size was 4 nm. As a result, very high film hardness of Hv 700 could be attained.

In Working Example 7, the same plating bath as Working Example 2 was used, except that the concentration, of acetic acid was raised to 2.10 mol/L. In this case, crystallite size was 4 nm. As a result, very high film hardness of Hv 710 could be attained.

In Working Example 8, the same plating bath as Working Example 1 was used, except that dimethylamine borane (DMAB) is used instead of TMAB as a supply source of boron (B). In this case, crystallite size was 4 nm. As a result, very high film hardness of Hv 710 could be attained.

In Working Example 9, the same plating bath as Working Example 2 was used, except that DMAB was used instead of TMAB. In this case, crystallite size was 4 nm. As a result, very high film hardness of Hv 700 could be attained.

In Comparative Example 6, the same plating bath as Working Example 2 was used, except that dimethyl sulfide borane (DMSB) was used instead of TMAB as a supply source of boron (B). As a result, film hardness was Hv 665, which is still insufficient.

From the above-mentioned results, it has been confirmed that current density can be increased to raise manufacturing efficiency while reducing occurrence of poor appearance, such as burning and abnormal precipitation, for example, and Ni—P—B system plating film which has high hardness can be deposited without baking processing, in accordance with the present invention. Namely, it has been confirmed that both the hardness and manufacturing efficiency of plating film can be achieved at a sufficiently high level.

Although some the embodiments and working examples having specific configurations have been explained sometimes referring to the accompanying drawings as mentioned above, for the purpose of explaining the present invention, it should not be interpreted that the scope, of the present invention is limited to these exemplary embodiments and working examples, and it is needless to say that any correction can be suitably added within the limits of the matters described in the claims and the specification.

The invention claimed is:

1. A deposition method of Ni-P-B system plating; film comprising:

electroplating the Ni-P-B film at a current density of 80 A/dm$^2$ or higher from a plating bath containing Ni ions, phosphorous acid ions, an alkylamine borane, acetic acid, at least one sort of a primary brightening agent, a secondary brightening agent and at least one surface active agent;

forming a film of crystallites of a size of from 4 nm to 10 nm measured by X-ray diffraction;

wherein a concentration of the alkylamine borane in said plating bath is 1.37 mmol/L or more, and a concentration of acetic acid in said plating bath is 0.70 mol/L or more and less than 2.80 mol/L.

2. The deposition method of Ni-P-B system plating film according to claim 1, wherein:

said alkylamine borane a trialkyl amine borane a dialkyl amine borane, and said surface active agent is an anionic surface active agent.

3. The deposition method of Ni-P-B system plating film according to claim 2, wherein:

said alkylamine borane is trimethylamine borane or dimethylamine borane, and said surface active agent is sodium dodecyl sulfate.

4. The deposition method of Ni-P-B system plating film according to claim 1, wherein:

current density is 100 A/dm2or more when performing said electroplating.

5. The deposition method of Ni-P-B system plating film according to claim 1, wherein a supply source of Ni ions-comprises at least one selected from the group consisting of nickel sulfate ($NiSO_4$), nickel sulfamate ($Ni(Ni_2SO_3)_2$) and nickel chloride ($NiCl_2$).

6. The deposition method of Ni-P-B system plating film according to claim 1, wherein the primary brightening agent comprises at least one selected from the group consisting of aromatic sulphonic acids, aromatic sulfonamides, and aromatic sulfonimides.

7. The deposition method of Ni-P-B system plating film according to claim 1, wherein the secondary brightening agent is at least one selected from the group consisting of aldehydes, allyl compounds, acetylene compounds and nitrites.

* * * * *